United States Patent [19]

Laapotti

[11] Patent Number: 4,568,423

[45] Date of Patent: Feb. 4, 1986

[54] APPARATUS WITH A LONG PRESS ZONE IN THE PRESS TREATMENT OF A WEB

[75] Inventor: Jorma Laapotti, Jyväskylä, Finland

[73] Assignee: Valmet Oy, Finland

[21] Appl. No.: 541,425

[22] Filed: Oct. 13, 1983

[30] Foreign Application Priority Data

Oct. 14, 1982 [FI] Finland ..... 823500

[51] Int. Cl.[4] ..... D21F 3/00

[52] U.S. Cl. ..... 162/358; 162/205; 100/156; 100/210

[58] Field of Search ..... 162/205, 358; 100/156, 100/210, 118, 121, 151

[56] References Cited

U.S. PATENT DOCUMENTS

| | | | |
|---|---|---|---|
| 3,853,698 | 12/1974 | Mohr | 162/358 |
| 3,970,515 | 7/1976 | Busker | 162/205 |
| 4,201,624 | 5/1980 | Mohr et al. | 162/205 |
| 4,427,492 | 1/1984 | Cronin | 162/358 |

FOREIGN PATENT DOCUMENTS

| | | | |
|---|---|---|---|
| 452200 | 10/1948 | Canada | 162/205 |
| 929773 | 5/1982 | U.S.S.R. | 162/358 |

*Primary Examiner*—S. Leon Bashore
*Assistant Examiner*—Andrew J. Anderson
*Attorney, Agent, or Firm*—Steinberg & Raskin

[57] ABSTRACT

Apparatus for the press treatment of a fiber web in a long or extended press zone includes a first press fabric loop in which a press roll is situated and a press shoe situated within a press belt loop which acts in opposition to the press roll, the latter being supported on a transverse beam. The press roll and press shoe together form an extended press zone through which the web to be pressed is guided. The press shoe includes a pressure chamber isolated from the external environment by sealing members and to which a pressure medium, such as a fluid under pressure, is passed. The pressure chamber acts within the extended press zone on the press belt. According to the invention, the pressure chamber of the press shoe comprises a hydrostatic pressure chamber which, when viewed in the direction of web run, is bounded at its front and rear by hydrodynamic press shoes which function both as sealing elements for the hydrostatic pressure chamber and, additionally, as press-shoe members which produce compression pressures on the press belt and on the web.

10 Claims, 9 Drawing Figures

APPARATUS WITH A LONG PRESS ZONE IN THE PRESS TREATMENT OF A WEB

BACKGROUND OF THE INVENTION

The present invention relates to pressing apparatus for fiber webs.

In particular, the present invention relates to apparatus having an extended press zone for the press treatment of a fiber web of the type which includes a press roll or the like, preferably provided with a hollow face, a first press fabric loop in which the press roll is situated, a press shoe arrangement which acts against or in opposition to the press roll which is supported on a transverse beam or the like, a press belt loop in which the press shoe arrangement is situated, wherein the press roll and press shoe arrangement together form a press zone through which the web to be pressed is guided to run. The press shoe arrangement includes a pressure chamber which is isolated from the external environment by sealing members and into which a pressure medium, such as fluid under pressure, is passed. The pressure chamber produces a pressure over a zone of action within the press zone on the press belt.

The invention also relates to an apparatus of the type described above in which stationary glide elements, which may be provided with a pressure chamber arrangement, essentially replace the press roll.

The commonest arrangement for dewatering fiber webs and, in particular, paper or cardboard webs, comprises conducting the web through a press nip defined by two rolls in opposed relationship with each other. Preferably, one or two press fabrics are conducted through the dewatering press nip in order to carry away the water pressed from the web and to also function to transport the web from the press nip.

As the production rates of paper machines increase, the dewatering of the web in the press section has become a major limiting factor with regard to production rates due to the fact that the press nips defined by a pair of rolls have a relatively short region of action and, therefore, the time spent by the web in such press nips is relatively short at high web speeds. A certain minimum time, however, is required in view of the flow resistance presented by the fiber structure of the web in order for the water to escape from the web and enter into the recessed surface of the press roll or rolls or the press fabric.

It is known to provide a plurality of successive press nips. For example, so-called compact press sections, such as the so-called "Sym-press" press section manufactured by Valmet Oy of Finland, or press sections comprising several separate successive press nips have been used in conventional press sections. However, press sections incorporating several nip presses require large spaces, especially where separate successive press nips are used. A compact press section of the type mentioned above presents difficulties with respect to the optimal placement of their various components as well as in their operation, e.g., with respect to carrying off paper broke. Moreover, expensive suction rolls are commonly employed in nip presses, such suction rolls having large energy requirements in order to produce a vacuum. Moreover, since a perforated shell is a necessity for such suction rolls, strength problems also arise in connection with their use.

Further, a web can only tolerate a certain maximum nip pressure so that an increase in dewatering through increasing the nip pressures is limited by the pressures which the web can tolerate.

Attempts to lengthen the press zone of the press nips through the use of larger diameter rolls and/or soft press fabrics have not proven entirely satisfactory for economic reasons, among others.

However, in view of the various dewatering considerations discussed above, and for other reasons, so-called long or extended nip presses have recently been designed. For example, such long or extended nip presses are disclosed in U.S. Pat. Nos. 3,808,092; 3,808,096; 3,840,429; 3,970,515; 4,201,624 and 4,229,253, and British application No. 20 57 027.

Further regarding the state of the art, reference is made to Finnish patent application No. 3554/72 and U.S. Pat. No. 3,783,097. A paper machine press arrangement is disclosed in the Finnish patent application in which a paper web is dewatered in a long press zone which is provided by means of appropriately tensioning flexible belts. However, this arrangement has the drawback that the mechanical strength of the press belts and their associated guide rolls impose a limit on the pressure that can be exerted on the web and, therefore, impose a limit on the extent of web dewatering which can be accomplished. An extended nip press is disclosed in the above-mentioned U.S. patent wherein a plurality of successive press shoes are urged towards a belt and opposing press roll. However, this arrangement has the drawback that the friction between the press shoes and the belt results in the consumption of large amounts of energy. Additionally, the belt and pressure shoes are subject to considerable attrition as a result of friction between them.

A press section incorporating a long or extended nip is disclosed in the above-mentioned U.S. Pat. No. 3,840,429 wherein the web being pressed runs rectilinearly through the press zone defined by a pair of opposed press shoes while interposed between a pair of felts. Pressure is produced in the press zone by means of a pressurized fluid. Belts are provided within the loops of the felts which bound the press zones and transmit the pressure of the pressurized fluid to the web. This extended nip press is not entirely satisfactory in view of sealing problems which are encountered in the press zone. Another drawback of this arrangement is that the web is instantaneously subjected to the total and necessarily high pressure in the nip. However, since the web has a relatively low dry matter content, it cannot tolerate pressures which exceed a certain maximum without breaking. For this reason, the nip pressures must be maintained at a relatively low level. Moreover, it is generally not advisable to subject a web to a high nip pressure which rises abruptly at the very beginning of the pressing operation.

SUMMARY OF THE INVENTION

Accordingly, it is an object of the present invention to provide new and improved press apparatus for pressing a fiber web, such as a paper or cardboard web in a paper machine press section.

Another object of the present invention is to provide a new and improved long or extended nip press in which the drawbacks mentioned above are avoided.

Still another object of the present invention is to provide a new and improved long or extended nip press in which friction forces are generated which are substantially lower than those generated in glide-shoe presses which operate to provide a corresponding press force.

A further object of the present invention is to provide a long or extended nip press in which the distribution of the pressure within the press zone on the web can be controlled in the direction of web run in advantageous manner.

A still further object of the present invention is to provide a new and improved extended nip press in which the lubricant used can be efficiently and advantageously fed over the entire width of the press zone onto the components of the press zone that rub against each other.

Yet another object of the present invention is to provide a new and improved long or extended nip press in which the glide shoes utilized can be made of a hard material, such as a ceramic or hard metallic material, so that the same are extremely wear resistant.

Briefly, in accordance with the present invention, these and other objects are attained by providing in the long or extended nip press of the type to which the present invention relates as described above, that the press shoe arrangement includes a hydrostatic pressure chamber which is bounded at its front and rear (in the direction of web run) as well as possibly at its sides, by hydrodynamic press shoes which are arranged to function at the hydrostatic pressure chamber both as sealing elements as well as press-shoe members for producing compression pressures on the press belt and on the web.

In accordance with the invention, a long or extended nip press is achieved which provides those advantages which characterize long nip presses in general, i.e., a sufficiently long distance and time over which the web passing therethrough is pressed.

Moreover, important advantages are obtained by the extended nip press of the invention in practice as compared to conventional extended nip presses. Since the press or glide shoes which bound the hydrostatic pressure chamber also function as sealing members for the pressure chamber, they can be made from a hard material and therefore be extremely wear resistant. As described below, the present invention provides the capability of favorably adjusting the distribution of the compression pressure in the direction of web run on the press zone. Furthermore, the lubricant for the glide or press shoes can be provided uniformly over the entire width of the press zone by means of lubricant feeding chambers constructed in accordance with the invention.

The friction forces between the press shoe arrangement and the press belt can be significantly reduced relative to prior art extended nip presses which utilize glide shoes.

In addition to providing an adjustability for the pressure distribution or profile in the direction of web run, the present invention also provides the capability of adjusting the pressure profile in a direction transverse to the direction of web run. The invention provides the possibility of performing a press treatment of paper or cardboard, wherein the adjustability of the pressure profile is important, in a single extended nip press with improved results to be expected as press felts are developed further. Still another advantage of the invention is that the construction of the press shoe arrangement in itself does not impose restrictions on the length of the press nip.

DETAILED DESCRIPTION OF THE DRAWINGS

A more complete appreciation of the present invention and many of the attendant advantages thereof will be readily understood by reference to the following detailed description when considered in connection with the accompanying drawings in which.

Figure 1:
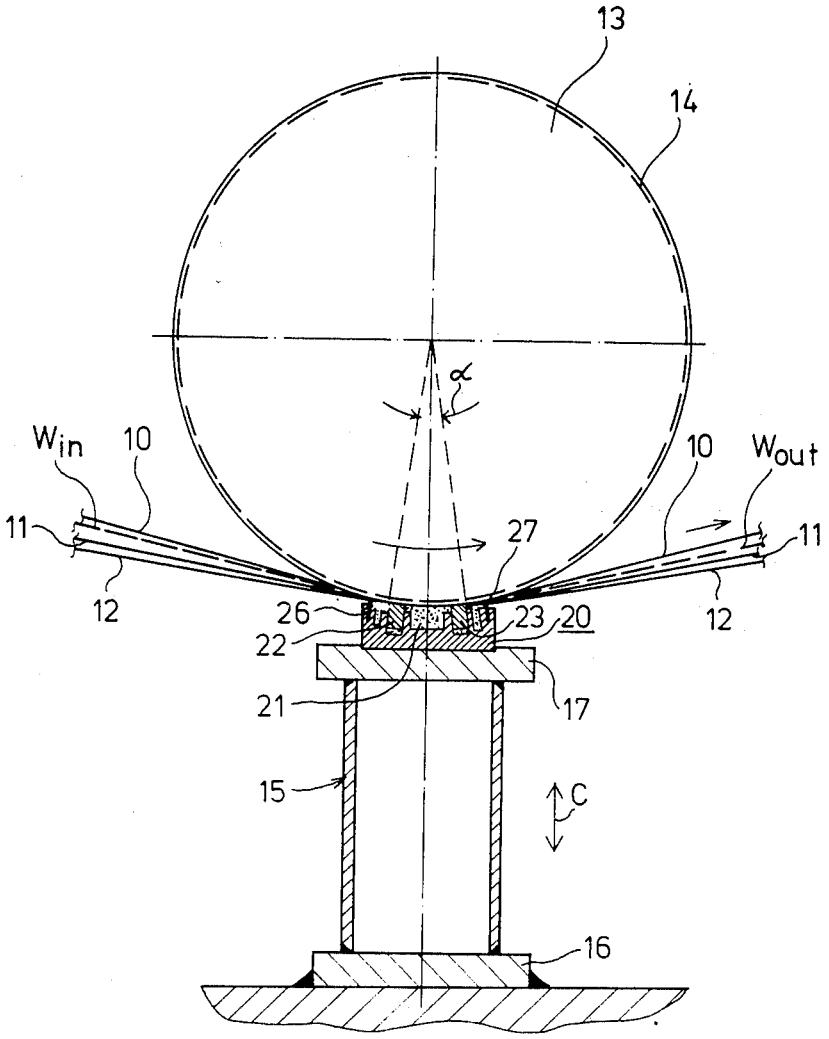
FIG. 1 is a schematic side elevation view of press apparatus for a fiber web in accordance with the present invention.
Figure 6:
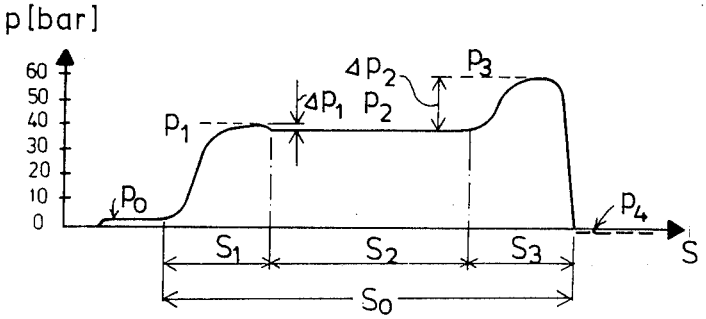
FIG. 6 is a graphical illustration similar to FIG. 3 showing the distribution of the compression pressure within the press zone of the arrangement illustrated in FIG. 5.
Figure 7:
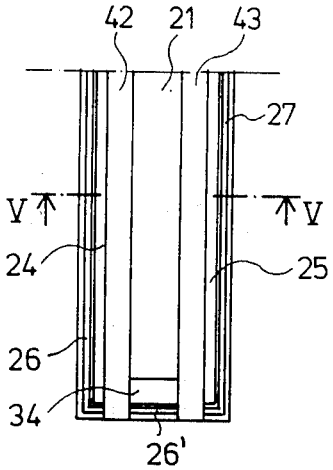
FIG. 7 is a view similar to FIG. 4 of the embodiment of the invention illustrated in FIG. 5.
Figure 8:
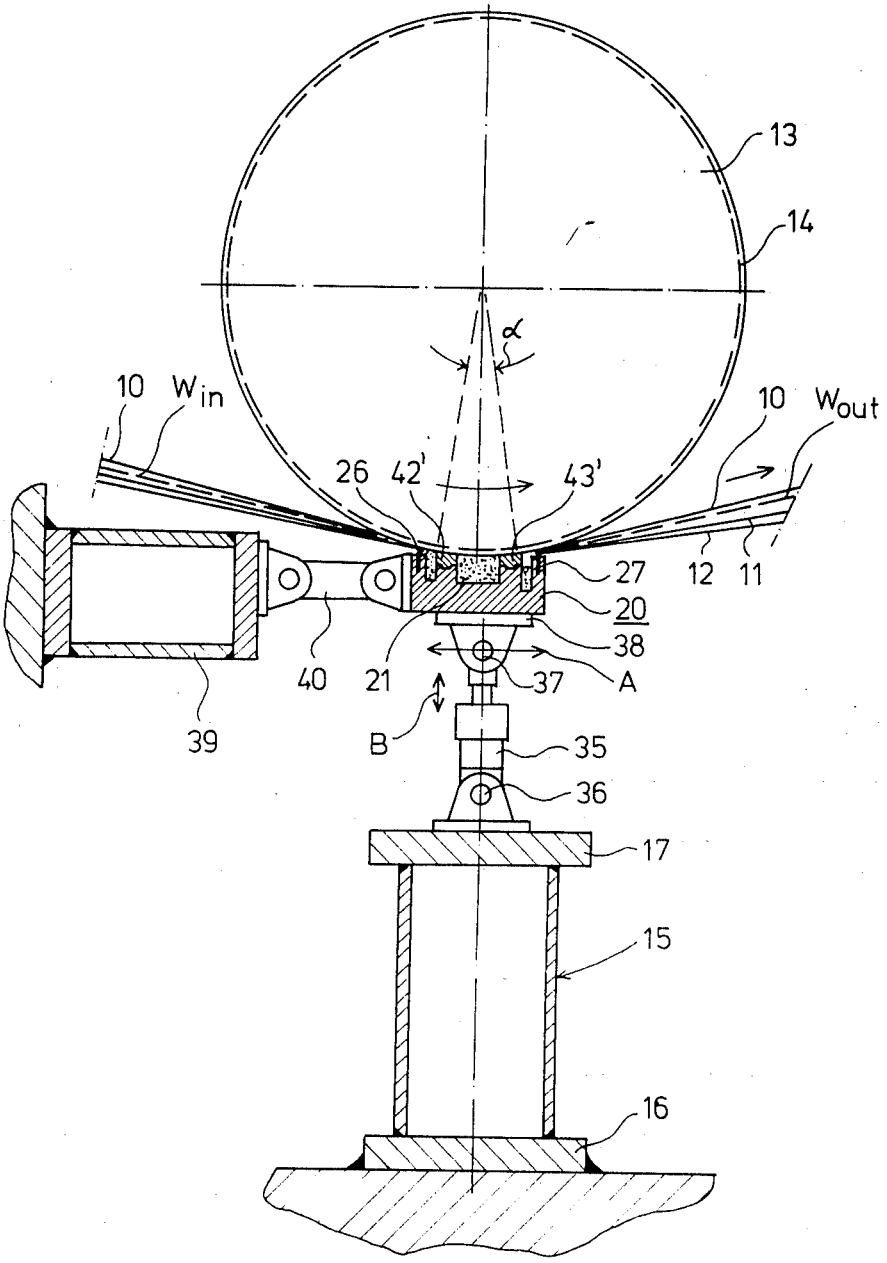
Figure 9:
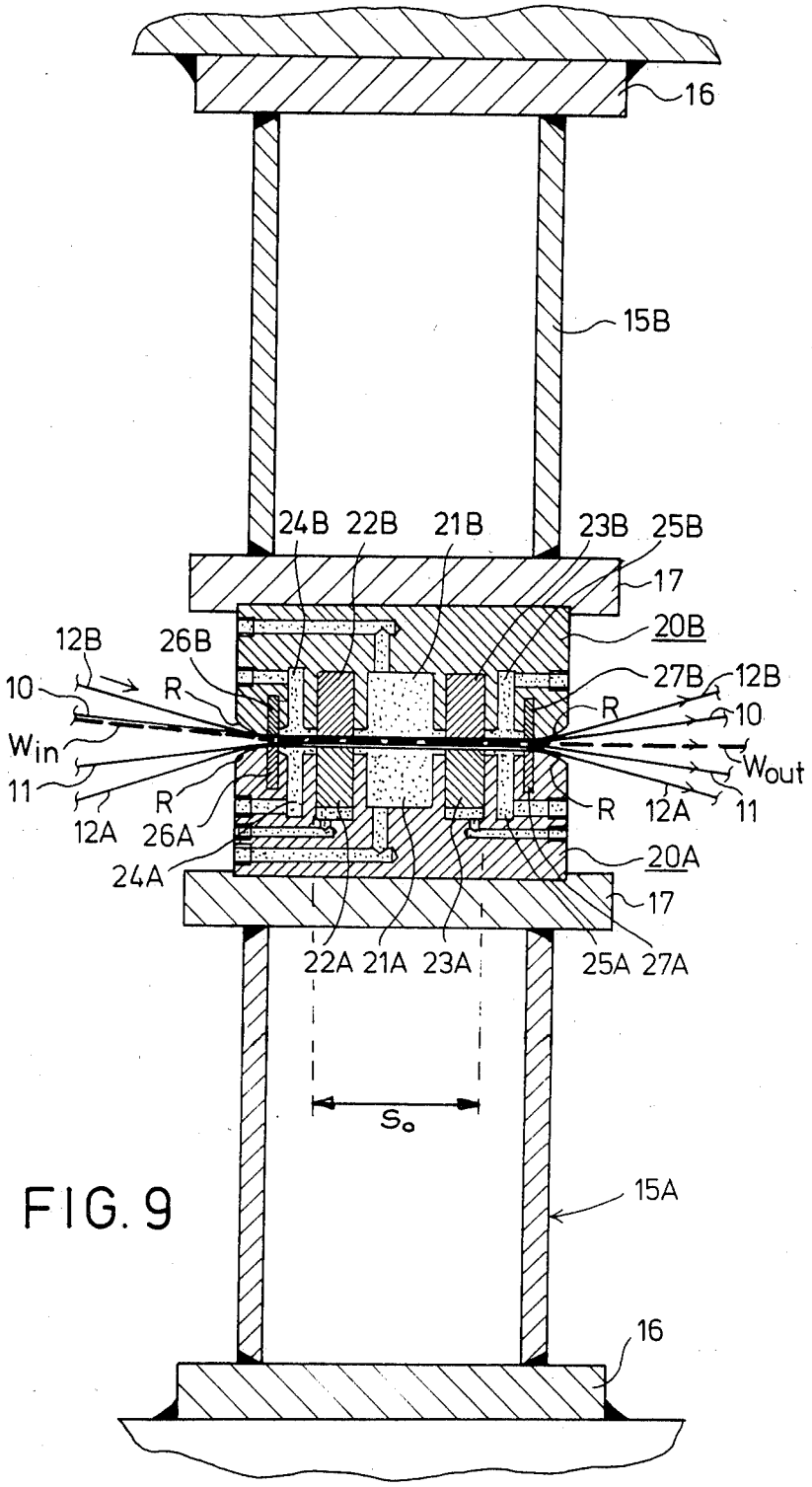

FIG. 8 is a view similar to FIG. 1 in illustrating an advantageous adjustable support arrangement for the press shoe arrangement so that the pressure distribution within the press zone can be adjusted; and FIG. 9 is a side elevation view in section of still another embodiment of the present invention wherein a stationary press shoe arrangement has replaced the press roll of the embodiments illustrated in FIGS. 1–8.

DESCRIPTION OF THE PREFERRED EMBODIMENTS

Referring now to the drawings wherein like reference characters designate identical or corresponding parts throughout the several views, and more particularly to the embodiment illustrated in FIG. 1, a paper web $W_{in}$ is introduced into an extended press nip zone formed between a press shoe arrangement 20 and an opposing sector $\alpha$ of a press roll 13, in which zone, hereinafter designated $\alpha$, water is mechanically removed from the web by pressing. The pressed web $W_{out}$ is passed in a conventional manner to the drying section (not shown) of the paper machine for drying by evaporation.

The runs of the upper felt loop 10 and of the lower felt 11 are guided by guide rolls (not shown) in a conventional manner and conventional felt conditioning devices are preferably provided for each felt loop. As in the case of a conventional press nip formed between a pair of press rolls, the felts 10 and 11 function to carry water removed from the web W within the press zone $\alpha$, forwardly out of the press zone and, if desired, to carry the web W onwards.

The press roll 13 comprises a recessed-surface roll, the recessed surface being designated 14. Thus, the surface of press roll 13 may be grooved or blind-drilled and the roll 13 may be provided with a variable crown. A portion of the water removed from the web W within the press zone $\alpha$, passes through the felt 10 into the recessed surface 14 of roll 13 which carries the water out of the press zone whereupon it is thrown or flung into a water-collecting trough (not shown) from which the water is forwardly conducted in a conventional manner.

A belt loop 12 guided by guide rolls (not shown) is situated within the loop of the lower felt 11. The belt 12 has a smooth surface and is preferably water-impervious. For example, the belt 12 may be constituted by a band formed of acid-resistant stainless steel, a plastic or rubber band provided with a reinforcing ply or any other suitable impervious band having an adequate strength. As described more fully below, the compression pressure of the press shoe arrangement 20 acts against the belt 12 which transmits the compression pressure through the lower felt 11 to the paper web W, the press roll 13 functioning as a counter-member for the compression produced by the shoe arrangement 20.

The press shoe arrangement 20 is mounted on a support beam 15, 16, 17 which is preferably provided with a variable crown. The support beam is preferably provided with actuating means (not shown) for shifting the position of the press shoe arrangement 20 out of its operative position in order to provide access to the press zone $\alpha$, when desired.

Figure 2:
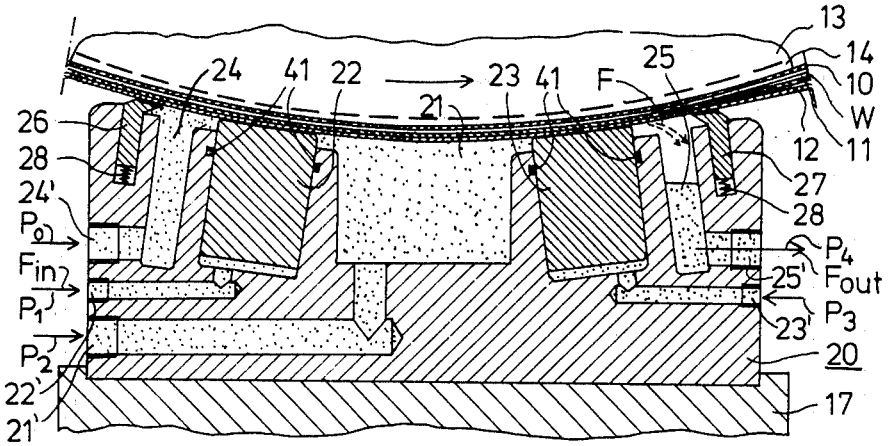
FIG. 2 is a side elevation view in section of a press shoe arrangement provided with sealing members in accordance with the invention, FIG. 2 constituting a section view taken along line II—II of FIG. 4.
Figure 4:
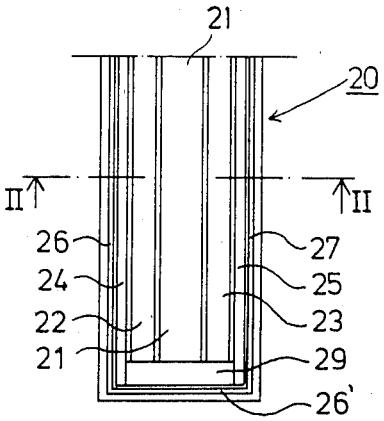
FIG. 4 is a schematic top plan view of the press shoe arrangement illustrated in FIG. 2.

Referring to FIGS. 2 and 4 in conjunction with FIG. 1, the press shoe arrangement 20 comprises two hydrodynamic shoes 22 and 23 between which a hydrostatic pressure chamber 21 is provided. A glide shoe 29 (FIG. 4) is provided at each transverse end of the pressure chamber 21, the glide shoes functioning as seal members. A lubricant feed chamber 24 is provided at the front side of the press shoe 22 in the direction of web run. Lubricant is introduced into the feeder chamber 24 through a passage 24', the lubricant being designated $F_{in}$. The forward edge of the lubricant feeder chamber 24 is bounded by a seal fillet 26 which is similar to a lip seal. The seal fillet 26 is situated within a transverse groove and is urged by means of springs 28 against the inner face of the press belt 12. The seal fillet 26 is provided at each of its transverse ends with continuing seals 26' (FIG. 4).

A lubricant discharge chamber 25 is provided at the rearward or downstream side of the second hydrodynamic press shoe 23 into which the lubricant is discharged as designated by F. The lubricant is removed from the discharge chamber 25 to passages 25' as shown by $F_{out}$ and is carried onwardly for recirculation. A similar seal fillet 27 with springs 28 is provided after the lubricant discharge chamber 25, as illustrated in FIG. 2.

The hydrodynamic press shoes 22 and 23 are pressed or urged by means of a pressure medium against the inner face of the press belt 12. Thus, the pressure medium is introduced into spaces situated behind the respective press shoes 22 and 23 through passages 22' and 23', respectively. Similarly a pressure medium is introduced into the hydrostatic pressure chamber 21 through a passage 21'. Each of the press shoes 22 and 23 is provided with seals 41 as seen in FIG. 2.

It is an important feature of the present invention that the hydrodynamic press shoes 22 and 23 function both as pressing members for applying a dewatering compression on the web W within the press zone $\alpha$, and at the same time as sealing members for the hydrostatic pressure chamber 21 which itself directs a compression pressure on the web W.

The pressure distribution or pressure profile acting on the web W as it passes through the extended press nip zone $\alpha$, in accordance with the invention, is extremely favorable and is described below in conjunction with reference to FIG. 3. The press nip zone is designated $S_0$ on the horizontal axis S in FIG. 3. A low pressure $p_0$ acts on the web W prior to the latter entering into the nip zone $\alpha$, the pressure $p_0$ prevailing in the lubricant feeder chamber 24 situated immediately behind the sealing fillet 26. The pressure acting on the web is increased to $p_1$ within the area $S_1$ in which the first hydrodynamic press shoe 22 acts. The pressure $p_1$ is somewhat greater than the pressure $p_2$ which prevails within the region of the hydrostatic pressure chamber 21 immediately behind the first press shoe 22. The difference in pressure, $\Delta p_1 = p_1 - p_2$, is important in that in this manner the hydrodynamic press shoe 22 also will then function as a sealing member as well as a pressing member for the pressure chamber 21. Within the area of the second hydrodynamic press shoe 23, the pressure is increased from the pressure $p_2$ to a higher pressure $p_3$, the latter being the maximum pressure acting on the web within the press zone $S_0$. The pressure $p_3$ diminishes relatively quickly to the pressure of the external environment, or possibly even to a slight negative pressure $p_4$ which prevails in the lubricant discharge chamber 25, by means of which the circulation of the lubricant is at least and partly generated. The pressure difference $\Delta p_2 = p_3 - p_2$ ensures the sealing of the trailing edge of the hydrostatic pressure chamber 21. The pressure difference $\Delta p_2$ is preferably substantially greater than the pressure difference $\Delta p_1$.

The stepwise increase of pressure acting on the web W as it passes through the extended press nip zone $\alpha$ from $p_0$ to $p_1$ ($p_2$) to $p_3$ is especially favorable in view of the pressing process. The greatest pressure $p_3$ preferably acts on the web within the area $S_3$ at the end of the press zone $S_0$. The final dry matter content for the web W obtained within the press zone is generally determined by the greatest pressure $p_3$.

Another important advantage obtained by the invention is that the sealing of the hydrostatic pressure chamber 21 is quite good. The hydrodynamic press shoes 22, 23 and 29, which additionally function as sealing members, can be made, either entirely or at least at their sides which rub against the inner face of the belt 12 of wear-resistant material, such as a ceramic material or an appropriate hard metallic material. Moreover, the provision of lubricant chambers 24 and 25 ensures an efficient lubrication between the compression belt 12 and the press shoes 22 and 23.

In the embodiment of the apparatus illustrated in FIGS. 1, 2 and 4, the compression pressures are easily adjusted by varying the pressures $p_1$, $p_2$ and $p_3$. For example, a single source of pressure medium can be provided with appropriate pressure-reduction valves so that the different pressures $p_1$, $p_2$ and $p_3$ are provided from the same source.

Figure 5:
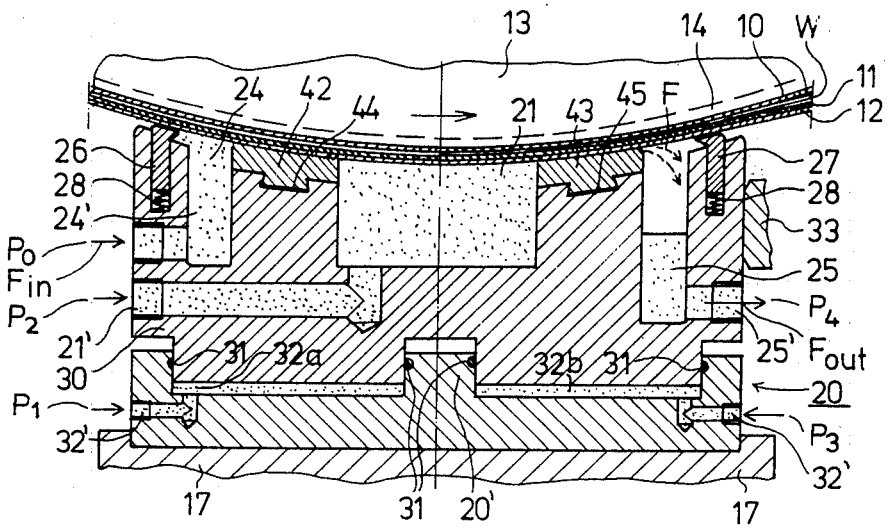
FIG. 5 is a view similar to FIG. 2 of another embodiment of a press shoe arrangement in accordance with the invention, FIG. 5 comprising a section view taken along line V—V of FIG. 7.

Referring now to FIGS. 5, 6 and 7, another embodiment of the invention will be described. As shown in FIG. 5, the press shoe arrangement 20 is provided with a piston part 30 which is loaded by a pair of pressure chambers **32*a* and 32*b* provided beneath the piston part under respective successive regions thereof in the direction of web run. A hydrostatic pressure chamber 21 is provided in the piston part 30. A lower or stationary part of the press shoe arrangement 20 has a fillet-shaped transverse projection 20' extending upwardly therefrom which is located in a corresponding groove provided in the lower surface of the piston part 30. The pressure chambers 32***a* and 32*b* are provided with seals 31. The pressure chambers 32*a* and 32*b* receive pressure medium under different pressures $p_1$ and $p_3$ respectively, the magnitudes of the respective pressures being illustrated in FIG. 6. The first hydrodynamic press shoe 42 is attached to the front side of the piston part 30 by means of a groove-and-tongue joint 44 and the second hydrodynamic press shoe 43 is attached to the rearward side of the piston part 30 by a similar joint 45. The compression pressure $p_1$ of the first hydrodynamic press shoe 42 is determined by the pressure of the medium in the first chamber 32*a*, and the pressure $p_3$ of the second hydrodynamic press shoe 43 is correspondingly determined by the pressure of the medium in the second chamber 32*b*. In this manner, the hydrodynamic shoes 42, 43 operate in a manner which corresponds to the operation of the shoes 22 and 23 of the embodiment illustrated in FIG. 2 and, like the previously described embodiment, also function as sealing members for the hydrostatic pressure chamber 21. The transverse ends of the hydrostatic pressure chamber 21 are provided with sealing members 34 (FIG. 7).

Figure 3:
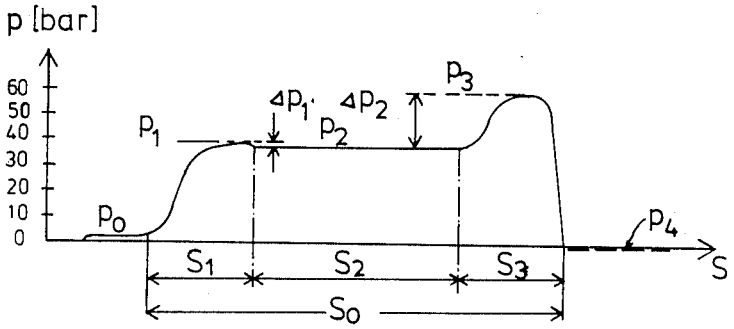
FIG. 3 is a graphical illustration of the distribution of the compression pressure obtained within the press zone in accordance with the invention.

As seen in FIG. 6, the pressure curve obtained by the embodiment of the apparatus illustrated in FIG. 5 is substantially the same as that illustrated in FIG. 3 despite the fact that the mechanical construction of the pressure shoe arrangement is considerably different therefrom.

Still referring to FIG. 5, a support piece 33 is provided at the trailing side of the piston part 30 which will receive any transfer forces directed from the compression belt 12 to the piston part 30 as a result of friction. In other material respects, the press shoe arrangement illustrated in FIGS. 5 and 7 is essentially similar to that shown in FIGS. 2 and 4.

Referring now to FIG. 8, a third embodiment of the invention is illustrated. According to the embodiment of FIG. 8, the pressure chamber construction of the press shoe 20 is essentially the same as that illustrated in FIG. 5. However, the press shoe arrangement 20 is not rigidly supported on the beams 15, 16 and 17. Rather, several piston-cylinder arrangements 35 are provided extending over the transverse length of the press shoe arrangement 20. Each piston-cylinder arrangement 35 is connected at its lower end by means of an articulated pin 36 to the upper flange 17 of the support beam. The upper end of each piston-cylinder arrangement 35, i.e., the piston rod side, is connected by means of an articulated pin 37 to the press shoe arrangement 20. Moreover, the front side of the press shoe arrangement 20 is fixed by means of articulated rods 40 to a stationary transverse beam 39. With respect to the connection of the upper end of the piston-cylinder arrangements 35 to the press shoe arrangement 20, the articulated pins 37 are associated with fastening brackets which themselves are fixed to respective slide members 38 by means of which the position of the support points of the press shoe arrangement 20 can be displaced in the direction of arrow A. The objective of this construction is the adjustment of the respective compressive pressures $p_1$ and $p_3$, i.e., to perform the same function as the pressure chambers 32*a* and 32*b* of the embodiment of FIG. 5. Thus, by adjusting the positions of the fastening points and the pressure in the loading cylinders 35, it is possible to vary the pressures $p_1$ and $p_3$, i.e., the compressive pressures which act on the web caused by the hydrodynamic press shoes 42' and 43'.

As noted above, several loading cylinders 35 are provided in side-by-side relationship in the transverse direction with respect to the direction of web travel. By causing the piston rods of the various pistion-cylinder arrangements 35 to provide upward forces in the direction of arrow B of different magnitudes, it is also possible to adjust the transverse profile of the compression pressure acting on the web.

Thus, in accordance with the embodiment of FIG. 8, the compression pressure profile acting on the web can be adjusted both in the transverse as well as in the longitudinal direction in a simple manner. Through the adjustment of the position of the slide member 38 in the direction of arrow A, the relative magnitudes of the pressures $p_1$ and $p_3$ can be adjusted as desired, such as to obtain the profile illustrated in FIG. 6. When the slide member 38 is positioned centrally with respect to the press shoe arrangement 20, the pressure $p_1$ and $p_3$ will be substantially equal with respect to each other. However, this case is not advantageous in practice. Rather, the slide member 38 is preferably shifted towards the side of the shoe 43' so that the pressure $p_3$ is substantially higher than the pressure $p_1$.

Referring now to FIG. 9 wherein yet another embodiment of the invention is illustrated, this particular embodiment does not utilize a press roll in the formation of the extended press zone. Rather, the press or counter-roll 13 is replaced by a stationary counter-shoe 20B.

According to the embodiment of FIG. 9, the first or lower press shoe arrangement 20A is substantially identical to that of the embodiment of FIG. 2. The press apparatus comprises two opposite press shoe arrangements, namely press shoe arrangements 20A and 20B having substantially planar opposed actuating faces. Moreover, the press apparatus comprises a pair of press belts 12A and 12B. The forward and trailing edges of the press shoe arrangements 20A and 20B are rounded as designated by R. The web W is guided between the actuating faces of the respective press shoe arrangements and is pressed between two felts 10 and 11. The press shoes 20A and 20B are supported on beams 15A and 15B, each beam having a pair of flanges 16 and 17.

The construction of the press shoe arrangements 20A and 20B is substantially similar to the construction described in the embodiment of FIG. 2 and are substantially symmetrical with respect to the plane of the web W which passes between them. The press shoes 20A and 20B are provided with respective opposed hydrostatic pressure chambers 21A and 21B and with respective opposed hydrodynamic press shoes 22A; 22B and 23A; 23B. The press shoes also function as sealing members for the respective hydrostatic pressure chambers 21A and 21B in the manner described above. The transverse ends of the respective pressure chambers are sealed in the same manner as described above in connection with the previous embodiments. Moreover, in a similar manner, each press shoe arrangement is provided with respective opposed lubricant feeder chambers 24A and 24B as well as lubricant discharge chambers 25A and 25B, the respective lubricant chambers being bounded by sealing elements 26A, 26B, and 27A, 27B. As seen in FIG. 9, the hydrodynamic press shoes 22B and 23B may be unloaded, i.e., passages for pressure medium are not provided in press shoe arrangement 20B.

The press apparatus of FIG. 9 can provide pressure distributions on the web which are substantially equal to those of the embodiments of FIGS. 3 and 6 through a suitable adjustment of the pressures of the pressure medium supplied into the pressure chambers 21A and 21B as well as through suitable control of the pressures acting on the hydrodynamic press shoes 22A and 23A. Of course, it is understood that the press shoes 22B and 23B may be similarly loaded through the provision of suitable pressure medium passages. The pressure medium can be supplied into the pressure chambers by means of a hydraulic pump, air compressor or the like.

The present invention provides a favorable distribution of pressure which is advantageous both from the web dewatering and web formation viewpoints as well as in view of the sealing of the pressure chambers, the pressure increasing according to the pressure distribution in a stepwise manner at appropriate intervals, whereupon the pressure is reduced in a relatively steep manner.

Any suitable medium can be utilized as the pressure medium. For example, water, a water-oil emulsion having, for example, 3% oil, hydraulic oil, semi-fluid grease, clean air or air with lubricant, may be used. The sector $\alpha$ of the extended pressure zone shown in FIGS. 1 and 8 is about 15°. In practice, the magnitude of the sector $\alpha$ may vary over relatively wide limits, e.g., between about 5° and 60°. The wider the sector $\alpha$ (or $S_0$) is, the longer are the pressing distances and times obtained when a press roll or countershoe of a certain extent is utilized.

When press felts 10 and 11 have a sufficiently high water-carrying capacity, it is possible to perform the dewatering of the paper or cardboard web by pressing using only a single extended nip press in accordance with the invention. In this case, the adjustability of the pressure profile both in the machine and transverse directions is important. The adjustment of the profile can, however, be provided in an easy manner as described above in the extended nip zone press of the present invention.

As can be seen from the figures, both the hydrodynamic press shoes 22, 23 and 42, 43 as well as the hydrostatic pressure chamber 21 have a remarkably large dimension in the direction of web run in order to achieve a sufficiently wide press zone $\alpha$, $S_0$. Preferably, the overall extent $S_1$ $S_3$ of the press shoes 22, 23 and 42, 43 in the direction of web run is substantially equal to the extent $S_2$ of the pressure chamber 21 in the same direction. Moreover, it is preferred that the extent $S_1$ and $S_3$ of the press shoes 22 and 23 as well as 42 and 43 in the direction of web run are substantially equal to each other, i.e., $S_1 \approx S_3$.

As shown in the graphs of FIGS. 3 and 6, the pressure $p_2$ in the pressure chamber 21 is preferably on the order of about 40 bar. The pressure $p_3$ of the second press shoe 23, 43, and 43', is substantially higher such, for example, as being on the order of about 60 bar.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Press apparatus having a long or extended press zone for pressing a fiber web, comprising:

a press roll;

a press shoe arrangement acting against said press roll forming an extended press zone between them through which the web to be pressed is guided to run;

a first press fabric loop within which said press roll is situated, said first press fabric passing through said extended press zone;

a press belt within which said press shoe arrangement is situated, said press belt passing through said extended press zone;

said press shoe arrangement including a hydrostatic pressure chamber acting within said extended press zone on said press belt, first passage means for supplying a pressure medium to said pressure chamber to provide a compressive pressure on said web through a central sector of said belt, first and second hydrodynamic press shoes bounding said hydrostatic pressure chamber, said first and second press shoes being situated forwardly and rearwardly of said hydrostatic pressure chamber respectively in the direction of web travel through said extended press zone, said hydrodynamic press shoes constituting means for both sealing said hydrostatic pressure chamber from the external environment and for providing respective first and second compressive pressures on said web through said first and second sectors of said press belt.

wherein said first and second hydrodynamic press shoes are substantially fillet-shaped, and fitted within respective first and second grooves provided in said press shoe arrangement; and including respective second passage means for supplying pressure medium into said grooves behind said first and second hydrodynamic press shoes at respective pressures for causing said first and second hydrodynamic press shoes to produce said respective compressive pressures on the web.

2. The combination of claim 1 wherein said press shoe arrangement further includes a lubricant feeder chamber situated forwardly of said first hydrodynamic press shoe in the direction of web run, a first sealing member for sealing a forward edge of said lubricant feeder chamber, third passage means for supplying lubricant at a low pressure into said lubricant feeder chamber whereby said lubricant is fed from said feeder chamber to lubricate the faces of said first and second hydrodynamic press shoes which rub against said press belt, and a lubricant discharge chamber situated rearwardly of said second hydrodynamic press shoe into which the lubricant fed from said feeder chamber is received to be discharged for recirculation.

3. The combination of claim 2 additionally comprising a second sealing member for sealing a trailing edge of said lubricant discharge chamber.

4. Press apparatus having a long or extended press zone for pressing a fiber web, comprising:

a press roll;

a press shoe arrangement acting against said press roll forming an extended press zone between them through which the web to be pressed is guided to run;

a first press fabric loop within which said press roll is situated, said first press fabric passing through said extended press zone;

a press belt within which said press shoe arrangement is situated, said press belt passing through said extended press zone;

said press shoe arrangement including a hydrostatic pressure chamber acting within said extended press zone on said press belt, first passage means for supplying a pressure medium to said pressure chamber to provide a compressive pressure on said web through a central sector of said belt, first and second hydrodynamic press shoes bounding said hydrostatic pressure chamber, said first and second press shoes being situated forwardly and rearwardly of said hydrostatic pressure chamber respectively in the direction of web travel through said extended press zone, said hydrodynamic press shoes constituting means for both sealing said hydrostatic pressure chamber from the external environment and for providing respective first and second compressive pressures on said web through said first and second sectors of said press belt, wherein said press shoe arrangement includes a piston part in which said hydrostatic pressure chamber is provided, said first and second hydrodynamic press shoes being fixed to said piston part, and said press shoe arrangement further comprising at least two pressure chamber means situated one after the other in the direction of web run for loading respective regions of said piston part with respective pressures of different magnitudes for causing said first and second hydrodynamic press shoes to produce said respective compressive pressures having different magnitudes on the web.

5. The combination of claim 4, wherein said press shoe arrangement further includes a lubricant feeder chamber situated forwardly of said first hydrodynamic press shoe in the direction of web run, a first sealing member for sealing a forward edge of said lubricant feeder chamber, second passage means for supplying lubricant at a low pressure into said lubricant feeder chamber whereby said lubricant is fed from said feeder chamber to lubricate the faces of said first and second hydrodynamic press shoes which rub against said press belt, and a lubricant discharge chamber situated rearwardly of said second hydrodynamic press shoe into which the lubricant fed from said feeder chamber is received to be discharged for recirculation.

6. Press apparatus having a long or extended press zone for pressing a fiber web, comprising:

a press roll;

a press shoe arrangement acting against said press roll forming an extended press zone between them through which the web to be pressed is guided to run;

a first press fabric loop within which said press roll is situated, said first press fabric passing through said extended press zone;

a press belt within which said press shoe arrangement is situated, said press belt passing through said extended press zone;

said press shoe arrangement including a hydrostatic pressure chamber acting within said extended press zone on said press belt, first passage means for supplying a pressure medium to said pressure chamber to provide a compressive pressure on said web through a central sector of said belt, first and second hydrodynamic press shoes bounding said hydrostatic pressure chamber, said first and second press shoes being situated forwardly and rearwardly of said hydrostatic pressure chamber respectively in the direction of web travel through said extended press zone, said hydrodynamic press shoes constituting means for both sealing said hydrostatic pressure chamber from the external environment and for providing respective first and second compressive pressures on said web through said first and second sectors of said press belt, wherein said first and second hydrodynamic press shoes are substantially fillet-shaped and extend transversely over substantially the entire width of the web and press belt, and wherein said hydrostatic presssure chamber has a pair of transverse ends which are situated between said first and second hydrodynamic press shoes, and further including end seal means for sealing said transverse ends of said hydrostatic pressure chamber.

7. The combination of claim 6, wherein said press shoe arrangement further includes a lubricant feeder chamber situated forwardly of said first hydrodynamic press shoe in the direction of web run, a first sealing member for sealing a forward edge of said lubricant feeder chamber, second passage means for supplying lubricant at a low pressure into said lubricant feeder chamber whereby said lubricant is fed from said feeder chamber to lubricate the faces of said first and second hydrodynamic press shoes which rub against said press belt, and a lubricant discharge chamber situated rearwardly of said second hydrodynamic press shoe into which the lubricant fed from said feeder chamber is received to be discharged for recirculation.

8. Press apparatus having a long or extended press zone for pressing a fiber web, comprising:

a press roll;

a press shoe arrangement acting against said press roll forming an extended press zone between them through which the web to be pressed is guided to run;

a first press fabric loop within which said press roll is situated, said first press fabric passing through said extended press zone;

a press belt within which said press shoe arrangement is situated, said press belt passing through said extended press zone;

said press shoe arrangement including a hydrostatic pressure chamber acting within said extended press zone on said press belt, first passage means for supplying a pressure medium to said pressure chamber to provide a compressive pressure on said web through a central sector of said belt, first and second hydrodynamic press shoes bounding said hydrostatic pressure chamber, said first and second press shoes being situated forwardly and rearwardly of said hydrostatic pressure chamber respectively in the direction of web travel through said extended press zone, said hydrodynamic press shoes constituting means for both sealing said hydrostatic pressure chamber from the external environment and for providing respective first and second compressive pressures on said web through said first and second sectors of said press belt, wherein said first and second press shoes are independently actuatable from one another.

9. The combination of claim 8 wherein said first and second hydrodynamic press shoes are substantially fillet-shaped and fitted within respective first and second grooves provided in said press shoe arrangement; and including respective second and third passage means each communicating with one of said respective grooves for supplying respective presssure medium therewithin.

10. The combination of claim 8, wherein said press shoe arrangement further includes a lubricant feeder chamber situated forwardly of said first hydrodynamic press shoe in the direction of web run, a first sealing member for sealing a forward edge of said lubricant feeder chamber, second passage means for supplying lubricant at a low pressure into said lubricant feeder chamber whereby said lubricant is fed from said feeder chamber to lubricate the faces of said first and second hydrodynamic press shoes which rub against said press belt, and a lubricant discharge chamber situated rearwardly of said second hydrodynamic press shoe into which the lubricant fed from said feeder chamber is received to be discharged for recirculation.

* * * * *